US008556385B2

(12) United States Patent
Burchette

(10) Patent No.: US 8,556,385 B2
(45) Date of Patent: Oct. 15, 2013

(54) SYSTEMS AND METHODS FOR IMAGING COMPONENTS HAVING A SINGLE ROW OF CONTACT PADS

(75) Inventor: Lynton R. Burchette, Sanford, NC (US)

(73) Assignee: Statis Control Components, Inc., Sanford, NC (US)

( * ) Notice: Subject to any disclaimer, the term of this patent is extended or adjusted under 35 U.S.C. 154(b) by 443 days.

(21) Appl. No.: 12/878,306

(22) Filed: Sep. 9, 2010

(65) Prior Publication Data

US 2012/0062964 A1 Mar. 15, 2012

(51) Int. Cl.
*B41J 2/14* (2006.01)

(52) U.S. Cl.
USPC ..... 347/49

(58) Field of Classification Search
USPC ..... 347/42, 49, 50
See application file for complete search history.

(56) References Cited

U.S. PATENT DOCUMENTS 6,502,917 B1 1/2003 Shinada
6,550,902 B2 4/2003 Shinada
6,648,445 B2 11/2003 Ishizawa
6,834,945 B2 12/2004 Ishizawa
6,979,079 B2 12/2005 Hashii
7,033,009 B2 4/2006 Shinada
7,101,021 B2 9/2006 Aruga
7,125,100 B2 10/2006 Ishizawa
7,219,985 B2 5/2007 Shinada
7,237,882 B2 7/2007 Miyazawa
7,244,018 B2 7/2007 Hashii
7,252,375 B2 8/2007 Shinada
7,258,431 B2 8/2007 Shinada
7,264,334 B2 9/2007 Shinada
7,275,810 B2 10/2007 Shinada
7,278,708 B2 10/2007 Shinada
7,284,847 B2 10/2007 Shinada
7,284,850 B2 10/2007 Shinada
7,314,268 B2 1/2008 Aruga
7,467,854 B2 * 12/2008 Silverbrook et al. ..... 347/49

* cited by examiner

*Primary Examiner* — Lamson Nguyen

(57) ABSTRACT

A replacement imaging chip includes a single row of contact pads adapted for engagement with an imaging device having rows and columns of contacts, the single row of contact pads disposed to contact the rows and columns of contacts when the replacement imaging chip is installed in the imaging device.

2 Claims, 1 Drawing Sheet

SYSTEMS AND METHODS FOR IMAGING COMPONENTS HAVING A SINGLE ROW OF CONTACT PADS

BACKGROUND

The present invention generally relates to manufacturing and repairing replaceable imaging components, and more particularly to techniques for providing a cartridge chip comprising an improved contact pad layout for engaging an imaging device having contacts arranged in rows and columns.

In the imaging industry, there is a growing market for the remanufacture and refurbishing of various types of replaceable imaging components such as toner cartridges, drum cartridges, ink cartridges, and the like. Imaging cartridges, such as toner cartridges, once spent, are unusable for their originally intended purpose. Without a refurbishing process, they would simply be discarded, even though the cartridge itself may still have potential life. As a result, techniques have been developed specifically to address this issue. These processes may entail, for example, the disassembly of the various structures of the cartridge, replacing toner or ink, cleaning, adjusting or replacing any worn components and reassembling the cartridge.

Some imaging cartridges may include a cartridge chip having a memory device which is used to store data related to the cartridge or the imaging device. An imaging device may include laser printers, copiers, inkjet printers, facsimile machines and the like, for example. The imaging device, such as the printer, reads this data stored in the memory device to determine certain printing parameters and communicate information to the user. For example, the memory may store the model number of the cartridge so that the printer may recognize the cartridge as one which is compatible with that particular printer. Additionally, by way of example, the cartridge memory may store the number of pages that can be expected to be printed from the imaging cartridge during a life cycle of the cartridge and other useful data. The imaging device may also write certain data to the memory device, such as the amount of toner remaining in the cartridge. Other data stored in the cartridge may relate to the usage history of the imaging cartridge.

SUMMARY

In one aspect of the present invention, a replacement imaging chip includes a single row of contact pads adapted for engagement with an imaging device having rows and columns of contacts, the single row of contact pads disposed to contact the rows and columns of contacts when the replacement imaging chip is installed in the imaging device.

In another aspect of the present invention, a method of providing a replacement imaging chip for a used imaging chip includes providing the replacement imaging chip having a single row of contact pads adapted for engagement with an imaging device having rows and columns of contacts, the single row of contact pads disposed to contact the rows and columns of contacts when the replacement imaging chip is installed in the imaging device; and replacing the used imaging chip having rows and columns of contact pads with the replacement imaging chip.

A more complete understanding of the present invention, as well as further features and advantages of the invention, will be apparent from the following detailed description and the accompanying drawings.

DETAILED DESCRIPTION

Figure 1:
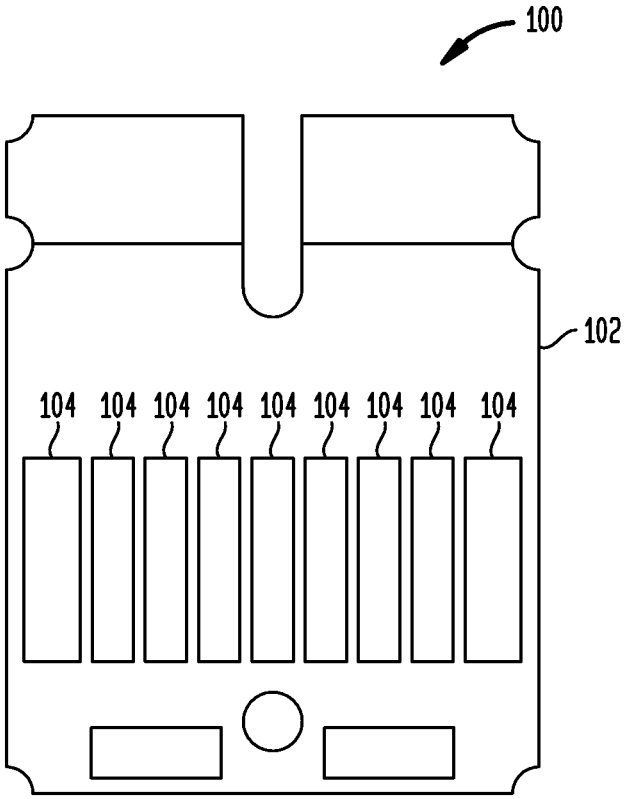
FIG. 1 shows a view of an a cartridge chip in accordance with the present invention.

The following detailed description of preferred embodiments refers to the accompanying drawings which illustrate specific embodiments of the invention. In the discussion that follows, specific systems and techniques for repairing, manufacturing or remanufacturing a toner cartridge including a memory element are disclosed. Other embodiments having different structures and operations for the repair, remanufacture and operation of other types of replaceable imaging components and for various types of imaging devices, such as laser printers, inkjet printers, copiers, facsimile machines and the like do not depart from the scope of the present invention.

FIG. 1 shows a front view of a replacement imaging chip 100 in accordance with the present invention. The replacement imaging chip 100 includes a printed circuit board (PCB) 102 having a single row of contact pads 104 which are positioned to engage the contacts of an imaging device, such as a printer, where the contacts of the imaging device are arranged in rows and columns. U.S. Pat. No. 6,979,079, which is incorporated by reference herein in its entirety, discloses an imaging device having contacts arranged in rows and columns and an imaging chip having contact pads arranged in rows and columns. The replacement imaging chip 100 may be used to replace the imaging chip having contacts arranged in rows and columns during the remanufacturing process. The single row of contact pads 104 advantageously engage the rows and columns of contacts of the imaging device when the replacement imaging chip 100 is installed in the imaging device.

Although specific embodiments have been illustrated and described herein, those of ordinary skill in the art appreciate that any arrangement which is calculated to achieve the same purpose may be substituted for the specific embodiments shown and that the invention has other applications in other environments. This application is intended to cover any adaptations or variations of the present invention. The following claims are in no way intended to limit the scope of the invention to the specific embodiments described herein.

What is claimed is:

1. A replacement imaging chip comprising:

a single row of contact pads adapted for engagement with an imaging device having rows and columns of contacts, the single row of contact pads disposed to contact the rows and columns of contacts when the replacement imaging chip is installed in the imaging device.

2. A method of providing a replacement imaging chip for a used imaging chip comprising:

providing the replacement imaging chip having a single row of contact pads adapted for engagement with an imaging device having rows and columns of contacts, the single row of contact pads disposed to contact the rows and columns of contacts when the replacement imaging chip is installed in the imaging device; and replacing the used imaging chip having rows and columns of contact pads with the replacement imaging chip having a single row of contacts.

* * * * *